US009514682B2

(12) United States Patent
Yang

(10) Patent No.: US 9,514,682 B2
(45) Date of Patent: Dec. 6, 2016

(54) ORGANIC LIGHT-EMITTING DISPLAY DEVICE AND DRIVING METHOD OF THE SAME

(71) Applicant: SAMSUNG DISPLAY CO., LTD., Yongin, Gyeonggi-Do (KR)

(72) Inventor: Jin Wook Yang, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 89 days.

(21) Appl. No.: 14/639,920

(22) Filed: Mar. 5, 2015

(65) Prior Publication Data

US 2016/0086541 A1 Mar. 24, 2016

(30) Foreign Application Priority Data

Sep. 19, 2014 (KR) ..... 10-2014-0125135

(51) Int. Cl.

*G09G 3/30* (2006.01)
*G09G 3/32* (2016.01)
*G09G 3/20* (2006.01)

(52) U.S. Cl.

CPC ..... *G09G 3/3258* (2013.01); *G09G 3/2022* (2013.01); *G09G 3/3291* (2013.01); *G09G 2300/0819* (2013.01); *G09G 2310/027* (2013.01); *G09G 2310/0278* (2013.01); *G09G 2320/043* (2013.01)

(58) Field of Classification Search

None

See application file for complete search history.

(56) References Cited

U.S. PATENT DOCUMENTS

2011/0007067 A1* 1/2011 Ryu ..... G09G 3/3233 345/214
2013/0314385 A1* 11/2013 Kim ..... G09G 3/3225 345/204

FOREIGN PATENT DOCUMENTS

| | | | |
|---|---|---|---|
| KR | 10-2011-0100219 | A | 9/2011 |
| KR | 10-2013-0131938 | A | 12/2013 |
| KR | 10-2014-0008399 | A | 1/2014 |
| KR | 10-2014-0013146 | A | 2/2014 |
| WO | WO 2010/080113 | A1 | 7/2010 |
| WO | WO 2012/114059 | A2 | 8/2012 |

* cited by examiner

*Primary Examiner* — Joseph Feild
*Assistant Examiner* — Ifedayo Iluyomade
(74) *Attorney, Agent, or Firm* — Lewis Roca Rothgerber Christie LLP

(57) ABSTRACT

An organic light-emitting display device displays a gray-scale level by time-dividing each frame into N sub-frames, the organic light-emitting display device including: a plurality of pixels arranged in a matrix; a plurality of scan lines to be provided with a plurality of scan signals to turn on the plurality of pixels; and a plurality of data lines to be selectively provided with a plurality of data voltages or a plurality of sensing voltages to be applied to a number of the pixels that are turned on by each of the plurality of scan signals, wherein the scan signals are provided to N scan lines (where N is a natural number greater than 1) that are randomly selected from among the plurality of scan lines at intervals of a sub-horizontal period.

19 Claims, 7 Drawing Sheets

FIG. 4

| SCAN SEQUENCE | | | | | BIT SEQUENCE Sub-Frames |
|---|---|---|---|---|---|
| 1~10 | 11~20 | --- | 5381~5390 | 5391~5400 | |
| 1 | 2 | --- | 539 | 540 | 0 |
| 474 | 475 | --- | 472 | 473 | 7 |
| 271 | 272 | --- | 269 | 270 | 9 |
| 538 | 539 | --- | 536 | 537 | 3 |
| 1 | 2 | --- | 539 | 540 | 1 |
| 540 | 1 | --- | 538 | 539 | 2 |
| 407 | 408 | --- | 405 | 406 | 8 |
| 534 | 535 | --- | 432 | 433 | 4 |
| 509 | 510 | --- | 507 | 508 | 6 |
| 526 | 527 | --- | 524 | 525 | 5 |
| Sub-H1 | Sub-H2 | --- | Sub-H539 | Sub-H540 | |

ORGANIC LIGHT-EMITTING DISPLAY DEVICE AND DRIVING METHOD OF THE SAME

CROSS-REFERENCE TO RELATED APPLICATION

This application claims priority to and the benefit of Korean Patent Application No. 10-2014-0125135 filed on Sep. 19, 2014 in the Korean Intellectual Property Office, the disclosure of which is incorporated herein by reference in its entirety.

BACKGROUND

1. Field

Aspects of some example embodiments of the present invention relate to an organic light-emitting display device and a driving method of the same.

2. Description of the Related Art

Organic light-emitting display devices have been widely used in accordance with recent attempts to miniaturize and lower the power consumption of electronic devices. Organic light-emitting display devices display a grayscale level using a voltage stored in a storage capacitor included in each pixel, and this type of driving method is referred to as an analog driving method. In the analog driving method, however, a grayscale level is rendered based on the voltage present in the storage capacitor of each pixel, and thus, a desired grayscale level may not be able to be precisely displayed. As such, attempts have been made to apply a digital driving method to organic light-emitting display devices. In the digital driving method, a single frame may be divided into a plurality of sub-frames having different lengths, which can each be represented as $2^n$, and a grayscale level can be represented based on the sum of the lengths of one or more sub-frames during which light is emitted.

However, the organic light-emitting elements of an organic light-emitting display device may deteriorate over time, and as a result, the luminance of light emitted in accordance with a data signal may gradually decrease. Thus, a method has been suggested in which a sensing current is flowed into the organic light-emitting elements, and the degree of emission of light from each of the organic light-emitting elements is measured, so as to detect and compensate for one or more organic light-emitting elements that are determined to have deteriorated.

This compensation method can be directly applied to the digital driving method. That is, a sensing current may be applied during a particular sub-frame to determine whether a particular organic light-emitting element has deteriorated. The sensing current, however, may be applied to other light-emitting elements than the particular organic light-emitting element, and as a result, the luminance of the organic light-emitting element may temporarily decrease. This luminance drop may be more apparent during the application of a sub-frame corresponding to a higher bit sequence, because during such higher-bit sequence sub-frame, light with a luminance corresponding to the sensing current continues to be emitted.

The above information disclosed in this Background section is only for enhancement of understanding of the background of the invention, and therefore, it may contain information that does not form the prior art that is already known to a person of ordinary skill in the art.

SUMMARY

Exemplary embodiments of the present invention provide an organic light-emitting display device capable of minimizing or reducing the deterioration of the quality of display that may be caused by detecting deteriorated organic light-emitting elements.

Exemplary embodiments of the present invention provide a driving method of an organic light-emitting display device capable of minimizing or reducing the deterioration of the quality of display that may be caused by detecting deteriorated organic light-emitting elements.

However, exemplary embodiments of the present invention are not restricted to those set forth herein. The above and other exemplary embodiments of the present invention will become more apparent to one of ordinary skill in the art to which the present invention pertains by referencing the detailed description of the exemplary embodiments given below.

According to an exemplary embodiment of the present invention, an organic light-emitting display device displays a grayscale level by time-dividing each frame into N sub-frames, the organic light-emitting display device including: a plurality of pixels arranged in a matrix; a plurality of scan lines configured to be provided with a plurality of scan signals to turn on the plurality of pixels; and a plurality of data lines configured to be selectively provided with a plurality of data voltages or a plurality of sensing voltages to be applied to a number of the pixels that are turned on by each of the plurality of scan signals, wherein the scan signals are provided to N scan lines (where N is a natural number greater than 1) that are randomly selected from among the plurality of scan lines at intervals of a sub-horizontal period, the intervals of the sub-horizontal period being obtained by dividing a unit horizontal period for which a frame is displayed by a number of the plurality of scan lines, and wherein in response to the plurality of the sensing voltages being applied to a first group of pixels coupled to each of the N scan lines selected in a first sub-horizontal period, the first group of pixels are rescanned and provided with the plurality of the data voltages in a second sub-horizontal period that follows the first sub-horizontal period.

The plurality of scan lines may include first and second scan lines that are adjacent to each other, and a scan signal may be applied to the second scan line by shifting time by as much as a length of a sub-horizontal period from the application of a scan signal to the first scan line.

Each of the pixels may include: an organic light-emitting element; a driving transistor configured to drive the organic light-emitting element in response to a data voltage applied to the pixel from among the plurality of data voltages; a control transistor configured to transmit the applied data voltage to the driving transistor in response to a scan signal applied to the pixel from among the plurality of scan signals; and a sensing transistor configured to receive a sensing voltage applied to the pixel from among the plurality of sensing voltages.

The sensing transistor may be turned on by a sensing signal that may be output after the input of the applied scan signal to the control transistor to receive the applied sensing voltage.

The applied data voltage may be an "off" voltage for turning off the driving transistor.

The organic light-emitting display device may further include: a scan driver configured to provide the plurality of scan signals; a data driver configured to provide the plurality of data voltages; a sensing driver configured to provide the plurality of sensing voltages; and a sensing unit configured to output a plurality of sensing signals to the plurality of pixels, and to extract deterioration information from the plurality of pixels.

The organic light-emitting display device may further include: a controller configured to control the scan driver, the data driver, the sensing driver and the sensing unit, wherein the controller may be further configured to select the N scan lines, and to control the scan driver to output the scan signals to the N scan lines.

The controller may be further configured to control the sensing driver and the sensing unit to be selectively driven.

Scan signals may be sequentially applied to the N scan lines, respectively, and sub-frames corresponding to the sequentially-applied scan signals may have different lengths of emission periods.

The lengths of the emission periods may increase from one sub-frame to another sub-frame at a rate of $2^x$ (where x is an integer value).

In response to the first group of pixels being provided with the plurality of data voltages in the first sub-horizontal period, N new scan lines that may be different from the N selected scan lines from the first sub-horizontal period may be selected from among the plurality of scan lines in the second sub-horizontal period.

According to an exemplary embodiment of the present invention, an organic light-emitting display device displays a grayscale level by time-dividing each frame into N sub-frames, the organic light-emitting display device including: a plurality of pixels arranged in a matrix; a plurality of scan lines configured to be provided with a plurality of scan signals to turn on the plurality of pixels; and a plurality of data lines configured to be selectively provided with a plurality of data voltages or a plurality of sensing voltages to be applied to a number of the pixels that are turned on by each of the plurality of scan signals, wherein the plurality of scan lines comprise first and second scan lines that are adjacent to each other, and a scan signal is applied to the second scan line by shifting time by as much as a length of a sub-horizontal period from the application of a scan signal to the first scan line, the sub-horizontal period being obtained by dividing a unit horizontal period for which a frame is displayed by a number of the plurality of scan lines, and wherein in response to the plurality of sensing voltages being applied to a first group of pixels coupled to the first scan line in a first sub-horizontal period, the first group of pixels are rescanned and provided with the plurality of data voltages in a second sub-horizontal period that follows the first sub-horizontal period.

The sub-frames may have different lengths of emission periods, and the lengths of the emission periods may increase from one sub-frame to another sub-frame at a rate of $2^x$ (where x is an integer value).

In response to the first group of pixels being provided with the plurality of data voltages in the first sub-horizontal period, a scan signal may be provided to the first group of pixels coupled to the second scan line in the second sub-horizontal period.

According to an exemplary embodiment of the present invention, a driving method of an organic light-emitting display device includes: preparing an organic light-emitting display device configured to utilize a random scanning method, and to display a grayscale level by time-dividing each frame into N sub-frames, the organic light-emitting display device including: a plurality of pixels arranged in a matrix; a plurality of scan lines configured to be provided with a plurality of scan signals to turn on the plurality of pixels; and a plurality of data lines configured to be selectively provided with a plurality of data voltages or a plurality of sensing voltages to be applied to a number of the pixels that are turned on by each of the plurality of scan signals, wherein the scan signals are provided to N scan lines (where N is a natural number greater than 1) that are randomly selected from among the plurality of scan lines at intervals of a sub-horizontal period, the sub-horizontal period being obtained by dividing a unit horizontal period for which a frame is displayed by a number of the plurality of scan lines; determining a number of sensing pixels from among the plurality of pixels; and providing the plurality of sensing voltages to the sensing pixels, wherein the providing of the plurality of the sensing voltages includes: in response to providing the plurality of sensing voltages to a first group of pixels, which are coupled to each of the N scan lines selected in a first sub-horizontal period and do not include the sensing pixels therein, rescanning the first group of pixels and providing the plurality of data voltages to the first group of pixels in a second sub-horizontal period that follows the first sub-horizontal period.

The sub-frames may have different lengths of emission periods, and the lengths of the emission periods may increase from one sub-frame to another sub-frame at a rate of $2^x$ (where x is an integer value).

The method may further include selecting, in response to the first group of pixels being provided with the plurality of data voltages in the first sub-horizontal period, N new scan lines that may be different from the N selected scan lines from the first sub-horizontal period from among the plurality of scan lines in the second sub-horizontal period.

The method may further include selecting, in response to the first group of pixels being provided with the plurality of data voltages in the first sub-horizontal period, N scan lines that may be adjacent in a column direction to the N selected scan lines, respectively, from the first sub-horizontal period in the second sub-horizontal period.

In a third sub-horizontal period that follows the second sub-horizontal period, N new scan lines that may be different from the N selected scan lines from the first sub-horizontal period may be selected from among the plurality of scan lines.

According to some exemplary embodiments, it is possible to minimize or reduce the deterioration of the quality of display that may be caused by detecting deteriorated organic light-emitting elements.

BRIEF DESCRIPTION OF THE DRAWINGS

The above and other aspects and features of the present invention will become apparent to those skilled in the art from the following detailed description of the example embodiments with reference to the accompanying drawings.

FIG. 4 is a table illustrating a random scanning method according to an exemplary embodiment of the present invention.

DETAILED DESCRIPTION

Figure 1:
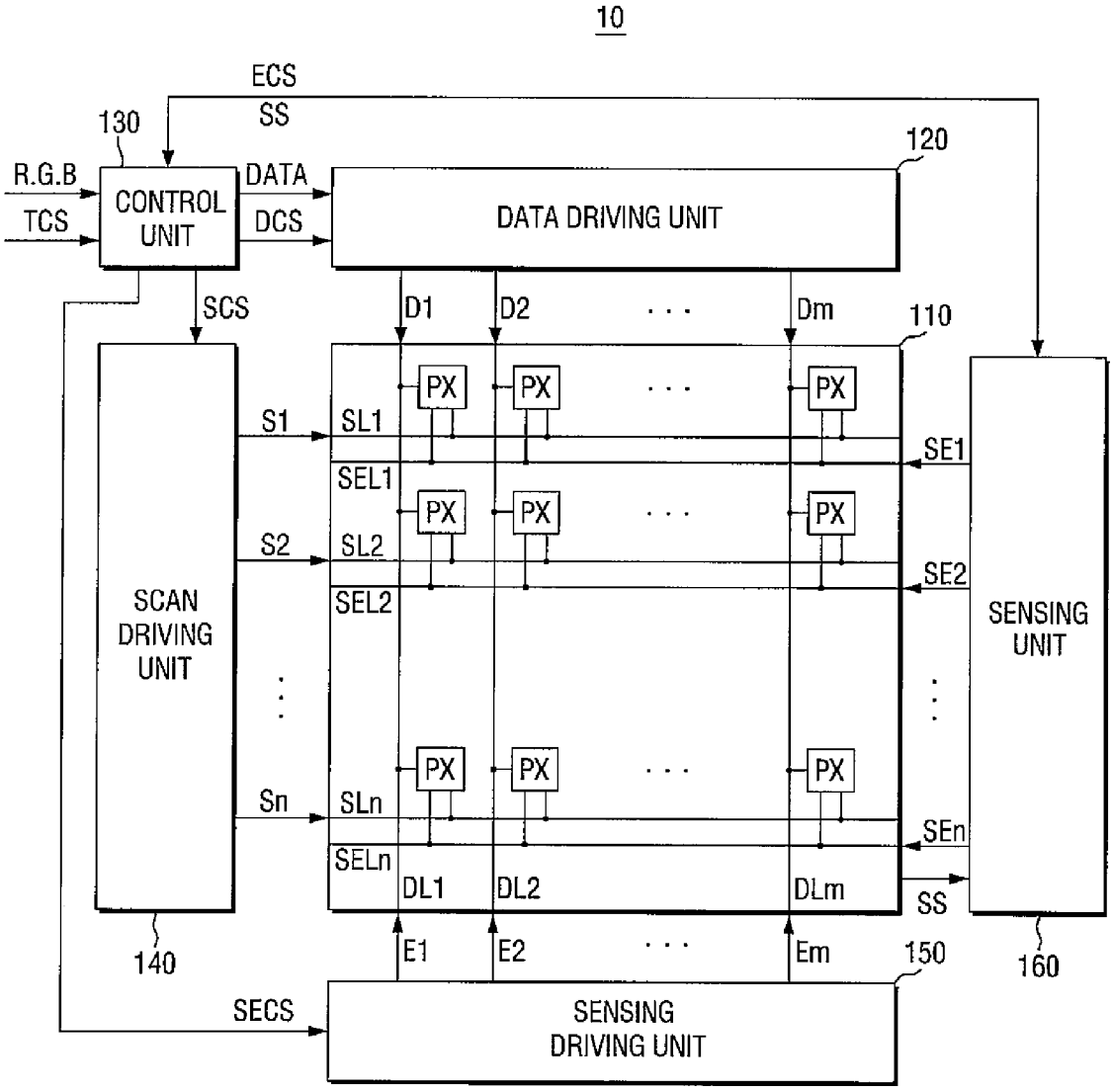
FIG. 1 is a schematic diagram of an organic light-emitting display device according to an exemplary embodiment of the present invention.

The aspects and features of the present invention and methods for achieving the aspects and features will be apparent by referring to the example embodiments to be described in detail with reference to the accompanying drawings. However, the present invention is not limited to the example embodiments disclosed hereinafter, but can be implemented in various forms. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

Although the terms "first, second, and so forth" are used to describe diverse constituent elements, such constituent elements are not limited by the terms. The terms are used only to distinguish a constituent element from other constituent elements. Accordingly, in the following description, a first constituent element may be a second constituent element.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Exemplary embodiments will hereinafter be described with reference to the accompanying drawings.

Figure 2:
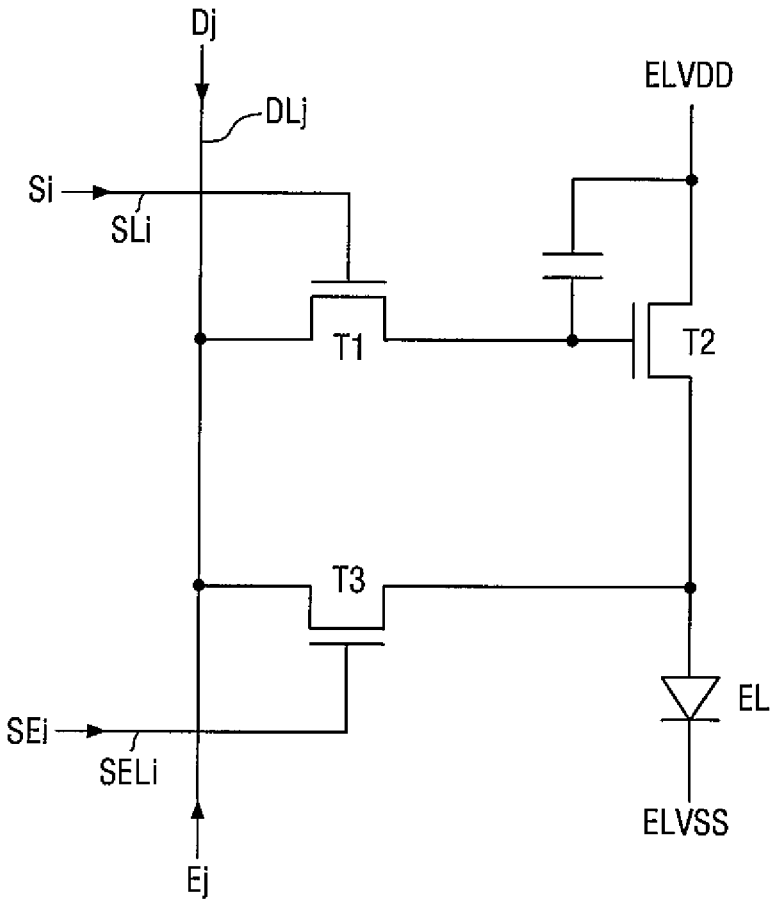
FIG. 2 is a circuit diagram of a pixel illustrated in FIG. 1.
Figure 3:
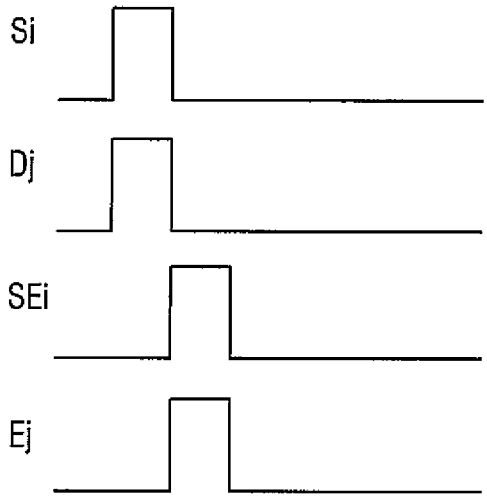
FIG. 3 is a waveform diagram illustrating the relationship between a scan signal and a sensing signal.

FIG. 1 is a schematic diagram of an organic light-emitting display device according to an exemplary embodiment of the present invention, FIG. 2 is a circuit diagram of a pixel illustrated in FIG. 1, and FIG. 3 is a waveform diagram illustrating the relationship between a scan signal and a sensing signal.

Referring to FIGS. 1 to 3, an organic light-emitting display device 10 includes a display unit 110 (e.g., a display), a data driving unit 120 (e.g., a data driver), a control unit 130 (e.g., a controller), a scan driving unit 140 (e.g., a scan driver), a sensing driving unit 150 (e.g., a sensing driver), and a sensing unit 160.

The display unit 110 may be a region where an image is displayed. The display unit 110 may include a plurality of scan lines SL1, SL2, . . . , SLn, a plurality of data lines DL1, DL2, . . . , DLm crossing the plurality of scan lines SL1, SL2, . . . , SLn, and a plurality of pixels PX. Each pixel PX is connected to one of the plurality of scan lines SL1, SL2, . . . , SLn, and one of the plurality of data lines DL1, DL2, . . . , DLm. The plurality of scan lines SL1, SL2, . . . , SLn may extend in a row direction, and may be substantially in parallel with one another. The plurality of scan lines SL1, SL2, . . . , and SLn may include first through n-th scan lines SL1 through SLn that are sequentially aligned. The plurality of data lines DL1, DL2, . . . , DLm may cross the plurality of scan lines SL1, SL2, . . . , SLn. That is, the plurality of data lines DL1, DL2, . . . , DLm may extend in a column direction, and may be substantially in parallel with one another.

The pixels PX may be arranged in a matrix. Each of the pixels PX may be connected to one of the plurality of scan lines SL1, SL2, . . . , SLn and one of the plurality of data lines DL1, DL2, . . . , DLm. Each of the pixels PX may receive one of a plurality of scan signals S1, S2, . . . , Sn from one of the plurality of scan lines SL1, SL2, . . . , SLn connected thereto, and may receive one of a plurality of data voltages D1, D2, . . . , Dm from one of the plurality of data lines DL1, DL2, . . . , DLm connected thereto in response to the receipt of one of the scan signals S1, S2, . . . , Sn. That is, the plurality of scan signals S1, S2, . . . , Sn may be provided to the plurality of scan lines SL1, SL2, . . . , SLn, respectively, and the plurality of data voltages D1, D2, . . . , Dm may be provided to the plurality of data lines DL1, DL2, . . . , DLm, respectively. A plurality of sensing voltages E1, E2, . . . , Em may also be provided to the plurality of data lines DL1, DL2, . . . , DLm, respectively. That is, a data voltage and a sensing voltage may both be applied via a single data line. Each of the pixels PX may be provided with a first power supply voltage ELVDD via a first power line, and a second power supply voltage ELVSS via a second power line.

As illustrated in FIG. 2, each of the pixels PX may include a control transistor T1, a driving transistor T2, a sensing transistor T3, and an organic light-emitting element EL (e.g., an organic light emitting device or diode). FIG. 2 illustrates a pixel PX connected to an i-th scan line SLi and a j-th data line DLj (where i and j are different natural numbers that are less than n and m, respectively), but the present invention is not limited to the structure of the pixel PX illustrated in FIG. 2. The gate of the control transistor T1 may be connected to the i-th scan line SLi, the source of the control transistor T1 may be connected to the j-th data line DLj, and the drain of the control transistor T1 may be connected to the gate of the driving transistor T2. That is, the control transistor T1 may be turned on by a scan signal Si applied to the i-th scan line SLi, and may transmit a data voltage provided to the j-th data line DLj to the gate of the driving transistor T2. The source of the driving transistor T2 may be connected to the first power supply voltage ELVDD, and the drain of the driving transistor T2 may be connected to the organic light-emitting element EL. A current corresponding to the relationship between the data voltage and the source-drain voltage of the driving transistor T2 may be generated in the channel of the driving transistor T2. The current may be a driving current for allowing the organic light-emitting element EL to emit light.

The driving transistor T2 may control the organic light-emitting element EL to emit light with a uniform luminance in response to the j-th data voltage being supplied to the driving transistor T2. The organic light-emitting element EL may emit light during each of a plurality of sub-frames of a frame, and a grayscale level (e.g., grayscale value) may be represented by summing up the amount of time for which the organic light-emitting element EL emits light during each of the plurality of sub-frames. That is, the organic light-emitting display device 10 may be driven by a digital driving method. The plurality of sub-frames may have different lengths of emission periods. The length of an emission period may increase from one sub-frame to another sub-frame at a rate of $2^x$ (where x is an integer value). For example, the emission period of a second sub-frame may be twice longer than the emission period of a first sub-frame, and the emission period of a third sub-frame may be twice longer than the emission period of the second sub-frame. A sub-frame with a longest emission period (or a maximum emission period) among other sub-frames may correspond to a most significant bit (MSB), and a sub-frame with a shortest emission period (or a minimum emission period) among other sub-frames may correspond to a least significant bit (LSB). During each of the emission periods of the plurality of sub-frames, the pixel PX may emit light by being provided with a data voltage corresponding to "1", or may not emit light by being provided with a data voltage corresponding to "0". That is, each of the plurality of sub-frames may be either an emissive state or a non-emissive state, and a grayscale value may be represented based on the sum of the lengths of one or more sub-frames during which the pixel PX emits light. The digital driving method will be described later in further detail.

The display unit 110 may also include a plurality of sensing lines SEL1, SEL2, . . . , SELn, which extend in parallel with the plurality of scan lines SL1, SL2, . . . , SLn. Each of the gates of the sensing transistors T3 of the pixels PX may be connected to one of the plurality of sensing lines SEL1, SEL2, . . . , SELn. The plurality of sensing lines SEL1, SEL2, . . . , SELn may be provided with a plurality of sensing signals SE1, SE2, . . . , SEn, respectively, and each of the sensing transistors T3 of the pixels PX may be turned on by one of the plurality of sensing signals SE1, SE2, . . . , SEn. For example, as illustrated in FIG. 2, the drain of the sensing transistor T3 may be connected to the j-th data line DLj, and as a result, a sensing voltage Ej may be provided to the organic light-emitting element EL via the source of the sensing transistor T3. The sensing voltage Ej may be applied via the j-th data line DLj to which the data voltage Dj is also applied. That is, the j-th data line DLj may be used to transmit both the sensing voltage Ej and the data voltage Dj. The organic light-emitting element EL may emit light with a brightness corresponding to the sensing voltage Ej. The sensing voltage Ej may be a voltage for generating a current for testing the organic light-emitting element EL to determine whether the organic light-emitting element EL has deteriorated, and may be lower than the data voltage corresponding to the "1". The organic light-emitting display device 10 may also include a luminance measurement unit (e.g., a luminance measurer) or a current measurement unit (e.g., a current measurer), which measures the brightness or an output current, respectively, of each of the organic light-emitting elements EL of the pixels PX. Deterioration information SS measured from each of the organic light-emitting elements EL of the pixels PX may be provided to the sensing unit 160, and the sensing unit 160 may transmit the deterioration information SS to the control unit 130. The control unit 130 may compensate for a data voltage to be applied to each of the pixels PX based on the deterioration information SS. That is, the organic light-emitting display device 10 may apply a sensing voltage to each of the pixels PX, and thus, may acquire the deterioration information SS from each of the organic light-emitting elements EL of the pixels PX. Then, the organic light-emitting display device 10 may compensate for a level of the data voltage to be applied based on the deterioration information SS, but the present invention is not limited thereto.

The data driving unit 120 may provide the plurality of data voltages D1, D2, . . . , Dm to the plurality of data lines DL1, DL2, . . . , DLm, respectively, of the display unit 110. Since the organic light-emitting display device 10 is driven by the digital driving method, each of the plurality of data voltages D1, D2, . . . , Dm may be a digital signal for transmitting the data value of "1" or "0". That is, each of the plurality of data voltages D1, D2, . . . , Dm may be an "on" voltage corresponding to the data value of "1" and capable of turning on the driving transistors of the pixels PX, or may be an "off" voltage corresponding to the data value of "0" and capable of turning off the driving transistors of the pixels PX. To ensure precise measurement results with the use of the plurality of sensing voltages E1, E2, . . . , Em, the driving transistors of the pixels PX may be turned off during the application of the plurality of sensing voltages E1, E2, . . . , Em. That is, an "off" voltage (e.g., a black voltage) corresponding to the data value of "0" may be applied to the driving transistors of the pixels PX before (e.g., immediately before) the application of the plurality of sensing voltages E1, E2, . . . , Em.

The control unit 130 may receive a timing control signal TCS and image data R.G.B from an external system. For example, the timing control signal TCS may include a vertical synchronization signal Vsync, a horizontal synchronization signal Hsync, a data enable signal DE, and a clock signal CLK. The control unit 130 may generate a scan control signal SCS for controlling the scan driving unit 140, and a data control signal DCS for controlling the data driving unit 130, based on the timing control signal TCS. For example, the data control signal DCS may be a source start pulse SSP, a source sampling clock SSC, or a source output enable signal SOE. For example, the scan control signal SCS may be a gate start pulse GSP or a gate sampling lock GSC.

The control unit 130 may provide a sensing driving control signal SECS to the sensing driving unit 150, and may provide a sensing control signal ECS to the sensing unit 160. The sensing driving control signal SECS may be a signal for controlling the output of the plurality of sensing voltages E1, E2, . . . , Em from the sensing driving unit 150. The sensing control signal ECS may be a signal for controlling the output of the plurality of sensing signals SE1, SE2, . . . , SEn from the sensing unit 160.

The sensing unit 160 may generate the plurality of sensing signals SE1, SE2, . . . , SEn, which corresponds to the plurality of sensing lines SEL1, SEL2, . . . , SELn, respectively, and may provide the plurality of sensing signals SE1, SE2, . . . , SEn to the plurality of sensing lines SEL1, SEL2, . . . , SELn, respectively. The sensing unit 160 may receive the deterioration information SS from the display unit 110, and may provide the deterioration information SS to the control unit 130. The control unit 130 may select a number of the pixels PX within a range (e.g., a predetermined range) as sensing pixels PX at a certain period of time, or whenever a certain event occurs, and may control the sensing unit 160 to output one or more sensing signals corresponding to the selected pixels PX. The present invention is not limited to when and how often the deterioration information SS is extracted, and the number of sensing pixels PX that are selected to extract the deterioration information SS therefrom. For example, the extraction of the deterioration information SS may be performed whenever power is applied to the organic light-emitting display device 10, or may be performed only once when the organic light-emitting display device 10 is shipped out. Further, for example, the sensing unit 160 may be driven according to a user setting (e.g., randomly or on demand), thereby performing the extraction of the deterioration information SS.

The sensing driving unit 150 may output the plurality of sensing voltages E1, E2, . . . , Em to the plurality of data lines DL1, DL2, . . . , DLm, respectively. In response to the deterioration information SS being extracted during the operation of the organic light-emitting display device 10, the control unit 130 may control the sensing driving unit 150 and the data driving unit 120 to be selectively driven, while considering that the plurality of sensing voltages E1, E2, . . . , Em and the plurality of data voltages D1, D2, . . . , Dm share the plurality of data lines DL1, DL2, . . . , DLm, respectively. That is, a data voltage and a sensing voltage may be applied to the same data line, but not at the same time. As illustrated in FIG. 3, an i-th sensing signal SEi may be output after the application of the i-th scan line Si, and an i-th sensing voltage Ej corresponding to the i-th sensing signal SEi may be output after the application of the data voltage Dj corresponding to the i-th scan line Si.

The scan driving unit 140 may generate the plurality of scan signals S1, S2, . . . , Sn, and may provide the plurality of scan signals S1, S2, . . . , Sn to the display unit 110. The plurality of scan signals S1, S2, . . . , Sn may be provided to the display unit 110 at a random order. For example, the scan driving unit 140 may randomly select N scan lines (where N may denote the number of sub-frames into which a frame is divided) from among the plurality of scan lines SL1, SL2, . . . , SLn at intervals of a sub-horizontal period Sub-H, which is obtained by dividing a unit horizontal period H for which a frame is displayed by the number of the plurality of scan lines SL1, SL2, . . . , SLn, i.e., n, and may provide the N scan lines with their respective scan signals. Each of a number of pixels PX that are turned on by the N scan signals applied to the N scan lines, respectively, may be provided with a data voltage or a sensing voltage. If each of a number of pixels that are turned on in a current sub-horizontal period Sub-H is provided with a sensing voltage, the organic light-emitting display device 10 may select the same N scan lines as those in the current sub-horizontal period Sub-H in a subsequent sub-horizontal period Sub-H, and may apply the same N scan signals as those in the current sub-horizontal period Sub-H to the N selected scan lines, respectively. Each of a number of pixels PX that are turned on in the subsequent sub-horizontal period Sub-H may be provided with a data voltage, which will hereinafter be described in further detail with reference to FIGS. 4 to 7.

Figure 5:
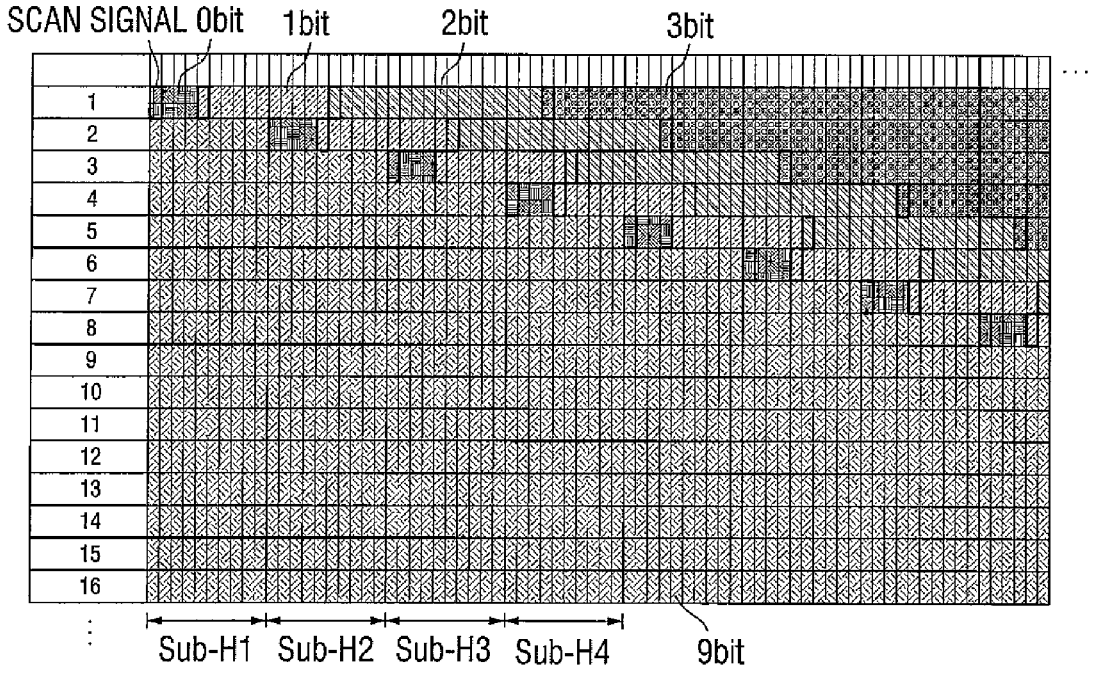
FIG. 5 is a diagram illustrating the application of data voltages in response to the application of scan signals as illustrated in FIG. 4.
Figure 6:
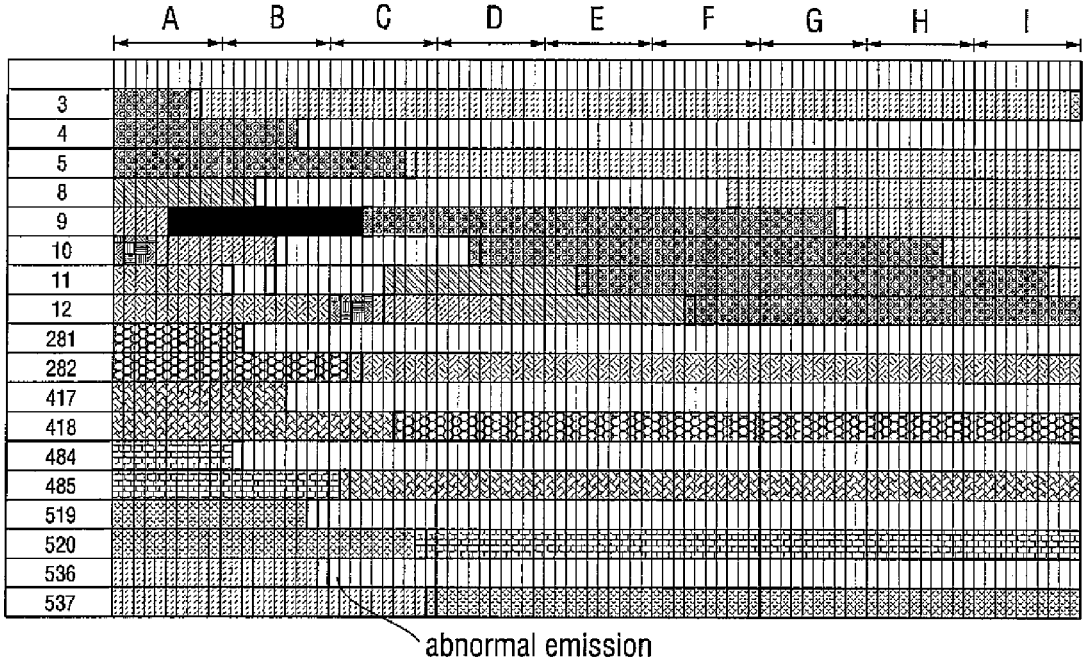
FIGS. 6 and 7 are diagrams illustrating the application of data voltages or sensing voltages in response to the application of scan signals as illustrated in FIG. 4.
Figure 7:
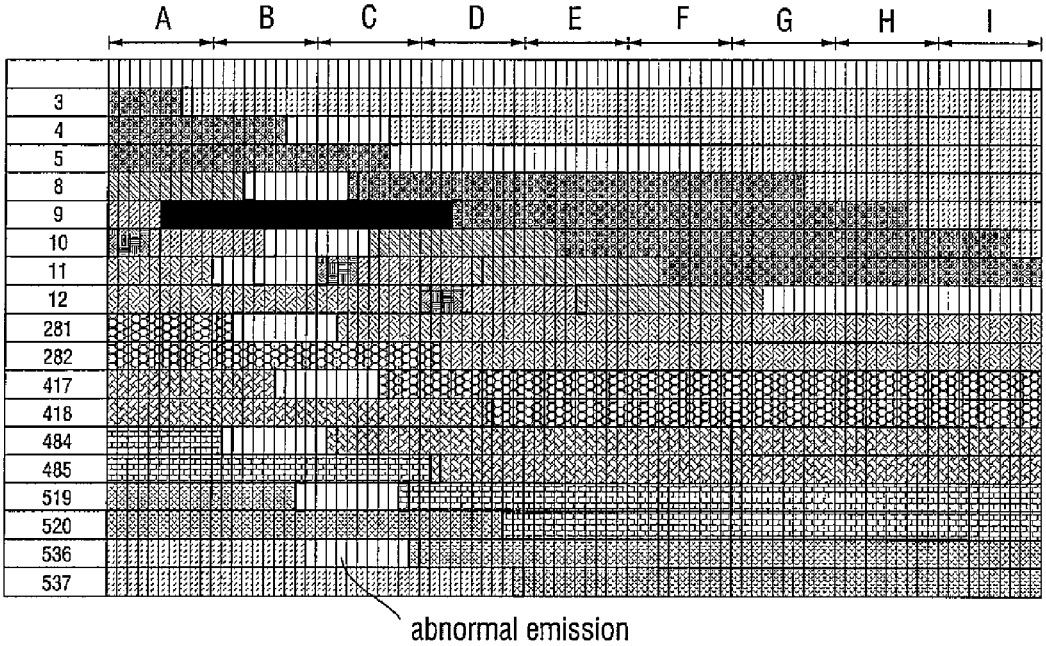

FIG. 4 is a table illustrating a random scanning method according to an example embodiment of the present invention, FIG. 5 is a diagram illustrating the application of data voltages in response to the application of scan signals as illustrated in FIG. 4, and FIGS. 6 and 7 are diagrams illustrating the application of data voltages or sensing voltages in response to the application of scan signals as illustrated in FIG. 4.

Referring to FIGS. 4 to 7, the organic light-emitting display device 10 may represent a data signal with zeroth to ninth bits as corresponding to a frame. That is, a single frame may be divided into ten sub-frames, and the ten sub-frames may correspond to the ten bits, respectively, of a data signal. As described above, each of the bits of a data signal may correspond to the length of a sub-frame of a frame. In an exemplary embodiment, the organic light-emitting display device 10 may be a display device with a resolution of 960×540, and the display unit 110 may include 540 scan lines. However, the present invention is not limited to this exemplary embodiment. Since a scan signal is provided to each scan line for each of the ten sub-frames of a frame, a scan signal may be applied a total of 5400 times during each frame. The scan driving unit 140 may randomly select ten scan lines from among the 540 scan lines for each sub-horizontal period Sub-H, which is obtained by dividing a unit horizontal period H for which a frame is displayed by 540, and may provide a scan signal to each of the ten scan lines. For example, $1^{st}$, $474^{th}$, $271^{st}$, $538^{th}$, $1^{st}$, $540^{th}$, $407^{th}$, $534^{th}$, $509^{th}$ and $526^{th}$ scan lines may be sequentially selected for a first sub-horizontal period Sub-H1, and a scan signal may be sequentially applied to each of the $1^{st}$, $474^{th}$, $271^{st}$, $538^{th}$, $1^{st}$, $540^{th}$ $407^{th}$, $534^{th}$, $509^{th}$ and $526^{th}$ scan lines. That is, the $1^{st}$ scan line may receive a scan signal first, and then, the $474^{th}$ scan line may receive a scan signal, etc. Each of the 540 scan lines, like the $1^{st}$ scan line, may be selected more than once for each sub-horizontal period Sub-H. The control unit 120 may select ten scan lines for each sub-horizontal period Sub-H, and may give instructions to output a scan signal to each of the ten selected scan lines to the scan driving unit 140.

Each of the ten selected scan lines may be allocated a data bit (e.g., a predetermined data bit). The ten selected scan lines may vary from one sub-horizontal period Sub-H to another sub-horizontal period Sub-H, but ten data bits, which are allocated to the ten selected scan lines, respectively, in consideration of the order in which to scan the ten selected scan lines, may be set by the control unit 150. For example, ten data voltages corresponding to 0, 7, 9, 3, 1, 2, 8, 4, 6, and 5 bit sequence sub-frames, respectively, may be sequentially applied in response to the application of a scan signal to each of the ten selected scan lines. That is, pixels connected to the $1^{st}$ scan line may be provided with the 0 bit sequence sub-frame, pixels connected to the $474^{th}$ scan line may be provided with the 7 bit sequence sub-f frame, pixels connected to the $271^{st}$ scan line may be provided with the 9 bit sequence sub-frame, etc. The application of the sub-frames to the rest of the ten selected scan lines is as illustrated in FIG. 4.

In response to the application of a scan signal to the ten selected scan lines in the first sub-horizontal period Sub-H1 being complete, ten new scan lines may be selected in a second sub-horizontal period Sub-H2. For example, ten scan lines that are adjacent in the column direction to the ten previously selected scan lines respectively, from the first sub-horizontal period Sub-H1 may be selected in the second sub-horizontal period Sub-H2. That is, $2^{nd}$, $475^{th}$, $272^{nd}$, $539^{th}$, $2^{nd}$, $1^{st}$, $408^{th}$, $535^{th}$, $510^{th}$, and $527^{th}$ scan lines, which are adjacent (e.g., next to) the $1^{st}$, $474^{th}$, $271^{st}$, $538^{th}$, $1^{st}$, $540^{th}$, $407^{th}$, $534^{th}$, $509^{th}$ and $526^{th}$ scan lines in the column direction, respectively, may be selected in the second sub-horizontal period Sub-H2. A scan signal may be sequentially applied to each of the ten new selected scan lines, and the data voltages corresponding to the 0, 7, 9, 3, 1, 2, 8, 4, 6, and 5 bit sequence sub-frames, respectively, may be applied.

A method of driving the organic light-emitting display device 10 according to some embodiments of the present invention will be described in further detail with reference to FIG. 5. In FIG. 5, blocks with bold outlines indicate the place and time of the application of a scan signal, and different sub-frames corresponding to different numbers of bits are marked with different patterns. Referring to FIGS. 4 and 5, the $1^{st}$ scan line may be selected as a first place to be scanned in a first sub-horizontal period Sub-H1, and a data voltage corresponding to the 0 bit sequence sub-frame may be applied to pixels connected to the $1^{st}$ scan line in response to the application of a scan signal to the $1^{st}$ scan line. A data voltage may be "1" or "0", and the pixels connected to the $1^{st}$ scan line may or may not emit light during a sub-frame period. The $1^{st}$ scan line may also be selected as the fifth place to be scanned in the first sub-horizontal period Sub-H1, and the pixels connected to the $1^{st}$ scan line may be provided with a data voltage corresponding to the 1 bit sequence sub-frame. The $1^{st}$ scan signal may also be selected as a sixth place to be scanned in a second sub-horizontal period Sub-H2, and each of the pixels connected to the $1^{st}$ scan line may be provided with a data voltage corresponding to the 2 bit sequence sub-frame. The sixth place to be scanned in the second sub-horizontal period Sub-H2 may come directly after the 1 bit sequence sub-frame. That is, after the 2 bit sequence sub-frame, the $1^{st}$ scan line may be selected as a fourth place to be scanned in a fourth sub-horizontal period Sub-H4, and the pixels connected to the $1^{st}$ scan line may be provided with a data voltage corresponding to the 3 bit sequence sub-frame.

A scan signal may be applied to a $2^{nd}$ scan line by shifting time by as much as the length of a sub-horizontal period Sub-H from the application of a scan signal to the $1^{st}$ scan signal. That is, in the first sub-horizontal period Sub-H1, each pixel connected to the $2^{nd}$ scan line may be maintained at the level of a data voltage corresponding to the 9 bit sequence sub-frame, applied in a previous sub-horizontal period. The $2^{nd}$ scan line may be selected as first and fifth places to be scanned in the second sub-horizontal period Sub-H2, and thus, the pixels connected to the $2^{nd}$ scan line may be provided with the data voltage corresponding to the 0 bit sequence sub-frame and the data voltage corresponding to the 1 bit sequence sub-frame.

That is, the digital driving method of the organic light-emitting display device 10 may be a random scanning method in which a number of scan lines to be scanned are selected for each scanning operation to be performed for each frame, and then a sub-frame data voltage is applied to pixels that are turned on by the scan signal.

A sensing operation for detecting deteriorated pixels during the operation of the organic light-emitting display device 10 may be performed mostly in the lower-bit sequence sub frame periods. As described above, during the sensing operation, an off voltage (e.g., a black voltage) may be applied as a data voltage, and a sensing voltage may be applied, following the data voltage.

That is, as illustrated in FIG. 6, during a sub-horizontal period A, a scan signal may be applied to a $9^{th}$ scan line as the sixth place among the ten selected scan lines of the sub-horizontal period A. FIG. 6 illustrates scan lines being randomly selected, scan signals applied to the scan lines, and sub-frame periods for convenience of illustration. Pixels connected to the $9^{th}$ scan line may be turned on by the scan signal applied to the $9^{th}$ scan line. To extract deterioration information, an "off" voltage (e.g., a black voltage) may be applied to the pixels connected to the $9^{th}$ scan line via their respective data lines. As described above, the "off" voltage may be a voltage for turning off the driving transistors of the pixels connected to the $9^{th}$ scan line (e.g., a data value of "0"). Information regarding the organic light-emitting elements of the pixels connected to the $9^{th}$ scan line can be extracted based on (e.g., solely on) a sensing voltage by turning off the driving transistors of the pixels connected to the $9^{th}$ scan line, so as to exclude other factors that may affect the detection of deteriorated pixels. A sub-frame for extracting deterioration information may be a low-bit sequence sub-frame, for example, a 3 or lower-bit sequence sub-frame. During the extraction of deterioration information, by applying the black voltage and the sensing voltage, pixels may suffer from luminance variations. In the 3 or lower-bit sequence sub-frame, a scan signal for applying a next-bit sequence sub-frame may be applied within a short sub-horizontal period of time, and thus, a user may not be able to recognize such luminance variations. Accordingly, to minimize the deterioration of the quality of display, deterioration information may be extracted from pixels by using a lower-bit sequence sub-frame.

After the application of a scan signal, the pixels connected to the 9-th scan line may be sequentially provided with a sensing signal, and may also be provided with sensing voltages. The sensing signal may be output after the input of the scan signal to the control transistors of the pixels connected to the 9-th scan line, and the sensing transistors of the pixels connected to the 9-th scan line may be turned on, and thus, may receive the sensing voltages. After the application of the scan signal to the 9-th scan line as the sixth place among the ten selected scan lines of the sub-horizontal period A, the sensing voltages, rather than the data voltages, may be applied to the data lines. In some exemplary embodiments, the sensing voltages may continue to be applied to the data lines, respectively, until the next sub-horizontal period, e.g., a sub-horizontal period B, begins. Accordingly, pixels connected to each of the ten selected scan lines of the sub-horizontal period B, e.g., $11^{th}$, $484^{th}$, $281^{st}$, $8^{th}$, $11^{th}$, $10^{th}$, $417^{th}$, $4^{th}$ $519^{th}$, and $536^{th}$ scan lines, may be provided with sensing voltages, respectively, rather than data voltages, via their respective data lines. That is, the sensing voltages may be applied to the driving transistors of the pixels connected to each of the $11^{th}$, $484^{th}$, $281^{st}$, $8^{th}$, $11^{th}$, $10^{th}$, $417^{th}$, $4^{th}$, $519^{th}$, and $536^{th}$ scan lines, and the level of a current in the organic light-emitting elements EL of the pixels connected to each of the $11^{th}$, $484^{th}$, $281^{st}$, $8^{th}$, $11^{th}$, $10^{th}$, $417^{th}$, $4^{th}$, $519^{th}$, and $536^{th}$ scan lines may vary. As a result, the organic light-emitting elements EL of the pixels connected to each of the $11^{th}$, $484^{th}$, $281^{st}$, $8^{th}$, $11^{th}$ $10^{th}$, $417^{th}$, $4^{th}$, $519^{th}$, and $536^{th}$ scan lines may not be able to properly emit light with a desired luminance (e.g., a predefined luminance). That is, an abnormal emission phenomenon, e.g., different luminance levels from the surroundings, may occur in some of the pixels connected to each of the $11^{th}$, $484^{th}$, $281^{st}$, $8^{th}$, $11^{th}$, $10^{th}$, $417^{th}$, $4^{th}$, $519^{th}$, and $536^{th}$ scan lines. If the abnormal emission phenomenon is continued only for a short period of time, the user may not be able to recognize the occurrence of the abnormal emission phenomenon. However, if the abnormal emission phenomenon occurs in connection with a higher-bit sequence sub-frame, the abnormal emission phenomenon may be continued for a long time. That is, since the abnormal emission occurs in the pixels connected to each of the $4^{th}$, $281^{st}$, $417^{th}$, $484^{th}$, and $536^{th}$ scan lines in connection with higher-bit sequence sub-frames, any luminance variations in the pixels connected to each of the $4^{th}$, $281^{st}$, $417^{th}$, $484^{th}$, and $536^{th}$ scan lines may be noticeable to the user.

To prevent or reduce the occurrence of luminance drops, in response to sensing voltages being applied to pixels in a first sub-horizontal period, the same or substantially the same scan lines as those selected in the first sub-horizontal period may be selected again in a second sub-horizontal period, which follows the first sub-horizontal period, and a scan signal may be applied to each of the re-selected scan lines to supply a data voltage to each of the pixels to which the sensing voltages are applied. That is, pixels that abnormally emit light upon the application of a sensing voltage thereto may be scanned again, and a data voltage may be applied to each of the abnormally-emitting pixels, thereby stopping the abnormally-emitting pixels from abnormally emitting light. As illustrated in FIG. 7, the ten selected scan lines from the sub-horizontal period B, e.g., the $11^{th}$, $484^{th}$, $281^{st}$, $8^{th}$, $11^{th}$, $10^{th}$, $417^{th}$, $4^{th}$, $519^{th}$, and $536^{th}$ scan lines, may be selected and scanned again, and each of the pixels connected to each of the $11^{th}$, $484^{th}$, $281^{st}$, $8^{th}$, $11^{th}$, $10^{th}$, $417^{th}$, $4^{th}$, $519^{th}$, and $536^{th}$ scan lines may be supplied with a data voltage, thereby stopping the pixels connected to each of the $11^{th}$, $484^{th}$, $281^{st}$, $8^{th}$, $11^{th}$, $10^{th}$, $417^{th}$, $4^{th}$, $519^{th}$, and $536^{th}$ scan lines from abnormally emitting light.

A sub-horizontal period C may begin, following the sub-horizontal period B. In the sub-horizontal period C, the control unit 140 may select ten new scan lines according to a predefined setting, and may apply ten data voltages corresponding to the ten new selected scan lines, respectively. That is, in the sub-horizontal period C, the control unit 140 may select ten new scan lines that are different from the ten selected scan lines from the sub-horizontal period B.

The organic light-emitting display device 10 may rescan, and apply a data voltage to, a group of pixels that abnormally emit light upon the application of a sensing voltage thereto. Accordingly, the organic light-emitting display device 10 may prevent or substantially prevent any luminance variations from being caused by an abnormal emission phenomenon, and may also prevent or substantially prevent the quality of display from deteriorating.

A driving method of an organic light-emitting display device, according to an exemplary embodiment will hereinafter be described with reference to FIGS. 1 through 7.

The driving method of an organic light-emitting display device, according to an exemplary embodiment, includes: preparing an organic light-emitting display device (s10), determining a number of sensing pixels (s20); and rescanning and providing a data voltage to each of the sensing pixels (s30).

More specifically, an organic light-emitting display device may be prepared (s10).

The organic light-emitting display device may employ a random scanning method, and may represent a grayscale level (e.g., a grayscale value) by time-dividing each frame into N sub-frames. The organic light-emitting display device may include a plurality of pixels, which are arranged in a matrix, a plurality of scan lines, which are provided with a plurality of scan signals for turning on the plurality of pixels, and a plurality of data lines, which are selectively provided with a plurality of data voltages or a plurality of sensing voltages to be applied to a number of pixels that are turned on by each of the plurality of scan signals. The organic light-emitting display device may randomly select N scan lines from among the plurality of scan lines at intervals of a sub-horizontal period, which is obtained by dividing a unit horizontal period for which a frame is displayed by the number of the plurality of scan lines. N scan signals may be provided to the N selected scan lines, respectively. In an exemplary embodiment, the N scan signals may be sequentially provided to the N selected scan lines, respectively. N sub-frames corresponding to the N scan signals, respectively, may be set to have different lengths of emission periods, wherein an emission period increases from one sub-frame to another sub-frame at a rate of 2" (where x is an integer value). Pixels that are turned on by the N selected scan lines may be provided with different data voltages corresponding to different sub-frames. A data voltage and a sensing voltage may be selectively provided to each of the plurality of data lines. The organic light-emitting display device may be substantially identical to the organic light-emitting display device 10 shown in FIGS. 1 to 4, and thus, a further description of step s10 will be omitted.

A number of sensing pixels may be determined (s20).

The control unit 130 may select from among the plurality of pixels a number of sensing pixels from which to extract deterioration information. The control unit 130 may select pixels within a range (e.g., a predetermined range) at a certain period of time, or whenever a certain event occurs, and may control the sensing unit 160 to output a sensing signal to the display unit 110. The present invention is not limited to when and how often the sensing unit 160 extracts the deterioration information and the number of sensing pixels that are selected to extract the deterioration information therefrom. For example, the sensing unit 160 may be driven according to a user setting to extract the deterioration information.

A sensing voltage may be provided to each of the sensing pixels (s30).

A sensing voltage may be provided to each of the sensing pixels that are selected in step s20. Before the application of a sensing voltage, an "off" voltage (e.g., a black voltage) may be applied to each of the driving transistors of the sensing pixels in response to the application of a scan signal to each of the sensing pixels. Information regarding the organic light-emitting elements of the sensing pixels can be extracted based on (e.g., based solely on) the sensing voltage by turning off the driving transistors of the sensing pixels, so as to exclude other factors that may affect the detection of the deteriorated pixels. The sensing signal may be applied after the application of the scan signal for applying the "off" voltage. That is, the sensing signal may be output after the input of the scan signal for applying the "off" voltage to the driving transistors of the sensing pixels, and as a result, the sensing transistors of the sensing pixels may be turned on, and thus, may receive a sensing voltage. A sensing voltage and a data voltage may be selectively applied via a single data line. After the application of the "off" voltage, a sensing voltage, rather than a data voltage, may continue to be applied to the data line until a subsequent sub-horizontal period begins. Accordingly, a sensing voltage may be applied to each of the pixels connected to a scan line selected in the first sub-horizontal period, for example, a first scan line, via their respective data lines, even though they are not planned to receive the sensing voltage. A sensing voltage may be different from a data voltage, and thus, may cause a luminance drop, e.g., an abnormal emission phenomenon, in the pixels connected to the first scan line.

To prevent or reduce the deterioration of the quality of display, in step s30, the pixels connected to the first scan line may be rescanned in a second sub-horizontal period that follows the first sub-horizontal period, and a data voltage may be applied to each of the pixels connected to the first scan line, thereby stopping the abnormal emission phenomenon caused by the application of a sensing voltage.

After the stopping of the abnormal emission phenomenon, a different group of scan lines from the group of scan lines selected in the first sub-horizontal period may be selected in a third sub-horizontal period that follows the second sub-horizontal period, and a normal driving operation may begin.

While some aspects of the present invention have been particularly shown and described with reference to exemplary embodiments thereof, the exemplary embodiments should be considered in a descriptive sense only, and not for purposes of limitation. Thus, it will be understood by those of ordinary skill in the art that various changes in form and details may be made therein, without departing from the spirit and scope of the present invention as defined by the following claims, and their equivalents.

What is claimed is:

1. An organic light-emitting display device configured to display a grayscale level by time-dividing each frame into N sub-frames, the organic light-emitting display device comprising:

a plurality of pixels arranged in a matrix;

a plurality of scan lines configured to be provided with a plurality of scan signals to turn on the plurality of pixels; and a plurality of data lines configured to be selectively provided with a plurality of data voltages or a plurality of sensing voltages to be applied to a number of the pixels that are turned on by each of the plurality of scan signals, wherein the scan signals are provided to N scan lines (where N is a natural number greater than 1) that are randomly selected from among the plurality of scan lines at intervals of a sub-horizontal period, the intervals of the sub-horizontal period being obtained by dividing a unit horizontal period for which a frame is displayed by a number of the plurality of scan lines, and wherein in response to the plurality of the sensing voltages being applied to a first group of pixels coupled to each of the N scan lines selected in a first sub-horizontal period, the first group of pixels are rescanned and provided with the plurality of the data voltages in a second sub-horizontal period that follows the first sub-horizontal period.

2. The organic light-emitting display device of claim 1, wherein the plurality of scan lines comprises first and second scan lines that are adjacent to each other, and a scan signal is applied to the second scan line by shifting time by as much as a length of a sub-horizontal period from the application of a scan signal to the first scan line.

3. The organic light-emitting display device of claim 1, wherein each of the pixels comprises:

an organic light-emitting element;

a driving transistor configured to drive the organic light-emitting element in response to a data voltage applied to the pixel from among the plurality of data voltages;

a control transistor configured to transmit the applied data voltage to the driving transistor in response to a scan signal applied to the pixel from among the plurality of scan signals; and a sensing transistor configured to receive a sensing voltage applied to the pixel from among the plurality of sensing voltages.

4. The organic light-emitting display device of claim 3, wherein the sensing transistor is configured to be turned on by a sensing signal that is output after the input of the applied scan signal to the control transistor to receive the applied sensing voltage.

5. The organic light-emitting display device of claim 4, wherein the applied data voltage is an "off" voltage for turning off the driving transistor.

6. The organic light-emitting display device of claim 1, further comprising:

a scan driver configured to provide the plurality of scan signals;

a data driver configured to provide the plurality of data voltages;

a sensing driver configured to provide the plurality of sensing voltages; and a sensing unit configured to output a plurality of sensing signals to the plurality of pixels, and to extract deterioration information from the plurality of pixels.

7. The organic light-emitting display device of claim 6, further comprising:

a controller configured to control the scan driver, the data driver, the sensing driver and the sensing unit, wherein the controller is further configured to select the N scan lines, and to control the scan driver to output the scan signals to the N scan lines.

8. The organic light-emitting display device of claim 7, wherein the controller is further configured to control the sensing driver and the sensing unit to be selectively driven.

9. The organic light-emitting display device of claim 1, wherein scan signals are sequentially applied to the N scan lines, respectively, and sub-frames corresponding to the sequentially-applied scan signals have different lengths of emission periods.

10. The organic light-emitting display device of claim 9, wherein the lengths of the emission periods increase from one sub-frame to another sub-frame at a rate of $2^x$ (where x is an integer value).

11. The organic light-emitting display device of claim 1, wherein in response to the first group of pixels being provided with the plurality of data voltages in the first sub-horizontal period, N new scan lines that are different from the N selected scan lines from the first sub-horizontal period are selected from among the plurality of scan lines in the second sub-horizontal period.

12. An organic light-emitting display device configured to display a grayscale level by time-dividing each frame into N sub-frames, the organic light-emitting display device comprising:

a plurality of pixels arranged in a matrix;

a plurality of scan lines configured to be provided with a plurality of scan signals to turn on the plurality of pixels; and a plurality of data lines configured to be selectively provided with a plurality of data voltages or a plurality of sensing voltages to be applied to a number of the pixels that are turned on by each of the plurality of scan signals, wherein the plurality of scan lines comprise first and second scan lines that are adjacent to each other, and a scan signal is applied to the second scan line by shifting time by as much as a length of a sub-horizontal period from the application of a scan signal to the first scan line, the sub-horizontal period being obtained by dividing a unit horizontal period for which a frame is displayed by a number of the plurality of scan lines, and wherein in response to the plurality of sensing voltages being applied to a first group of pixels coupled to the first scan line in a first sub-horizontal period, the first group of pixels are rescanned and provided with the plurality of data voltages in a second sub-horizontal period that follows the first sub-horizontal period.

13. The organic light-emitting display device of claim 12, wherein the sub-frames have different lengths of emission periods, and wherein the lengths of the emission periods increase from one sub-frame to another sub-frame at a rate of $2^x$ (where x is an integer value).

14. The organic light-emitting display device of claim 12, wherein in response to the first group of pixels being provided with the plurality of data voltages in the first sub-horizontal period, a scan signal is provided to the first group of pixels coupled to the second scan line in the second sub-horizontal period.

15. A driving method of an organic light-emitting display device, the driving method comprising:

preparing an organic light-emitting display device configured to utilize a random scanning method, and to display a grayscale level by time-dividing each frame into N sub-frames, the organic light-emitting display device comprising:

a plurality of pixels arranged in a matrix;

a plurality of scan lines configured to be provided with a plurality of scan signals to turn on the plurality of pixels; and a plurality of data lines configured to be selectively provided with a plurality of data voltages or a plurality of sensing voltages to be applied to a number of the pixels that are turned on by each of the plurality of scan signals, wherein the scan signals are provided to N scan lines (where N is a natural number greater than 1) that are randomly selected from among the plurality of scan lines at intervals of a sub-horizontal period, the sub-horizontal period being obtained by dividing a unit horizontal period for which a frame is displayed by a number of the plurality of scan lines;

determining a number of sensing pixels from among the plurality of pixels; and providing the plurality of sensing voltages to the sensing pixels, wherein the providing of the plurality of the sensing voltages comprises:

in response to providing the plurality of sensing voltages to a first group of pixels, which are coupled to each of the N scan lines selected in a first sub-horizontal period and do not include the sensing pixels therein, rescanning the first group of pixels and providing the plurality of data voltages to the first group of pixels in a second sub-horizontal period that follows the first sub-horizontal period.

16. The driving method of claim 15, wherein the sub-frames have different lengths of emission periods, and wherein the lengths of the emission periods increase from one sub-frame to another sub-frame at a rate of $2^x$ (where x is an integer value).

17. The driving method of claim 15, further comprising selecting, in response to the first group of pixels being provided with the plurality of data voltages in the first sub-horizontal period, N new scan lines that are different from the N selected scan lines from the first sub-horizontal period from among the plurality of scan lines in the second sub-horizontal period.

18. The driving method of claim 17, further comprising selecting, in response to the first group of pixels being provided with the plurality of data voltages in the first sub-horizontal period, N scan lines that are adjacent in a column direction to the N selected scan lines, respectively, from the first sub-horizontal period in the second sub-horizontal period.

19. The driving method of 15, wherein in a third sub-horizontal period that follows the second sub-horizontal period, N new scan lines that are different from the N selected scan lines from the first sub-horizontal period are selected from among the plurality of scan lines.

* * * * *